US009358443B2

(12) United States Patent
Morehouse et al.

(10) Patent No.: US 9,358,443 B2
(45) Date of Patent: Jun. 7, 2016

(54) CONTACT SENSING DEVICE AND SYSTEM

(71) Applicant: Morehouse USA Creative, LLC, New York, NY (US)

(72) Inventors: Timothy Morehouse, New York, NY (US); Jimmy Chion, San Francisco, CA (US); Kyle Doerkson, Menlo Park, CA (US); Brennon Williams, Hillsborough, CA (US)

(73) Assignee: MOREHOUSE USE CREATIVE, LLC, New York, NY (US)

( * ) Notice: Subject to any disclaimer, the term of this patent is extended or adjusted under 35 U.S.C. 154(b) by 354 days.

(21) Appl. No.: 13/998,678

(22) Filed: Nov. 22, 2013

(65) Prior Publication Data

US 2015/0148114 A1 May 28, 2015

(51) Int. Cl.
*A63B 69/02* (2006.01)
*A63B 71/06* (2006.01)

(52) U.S. Cl.
CPC ..... *A63B 71/0605* (2013.01); *A63B 69/02* (2013.01); *A63B 71/0669* (2013.01); *A63B 2220/801* (2013.01); *A63B 2225/50* (2013.01)

(58) Field of Classification Search
CPC ..... A63B 69/02; A63B 2220/0801; A63B 2225/50; A64B 71/0605; A64B 71/0669
See application file for complete search history.

(56) References Cited

U.S. PATENT DOCUMENTS

| | | | | |
|---|---|---|---|---|
| 2,819,361 | A | 1/1958 | Grace | |
| 3,529,802 | A | 9/1970 | Hall | |
| 4,030,731 | A | 6/1977 | Delcayre | |
| 6,575,837 | B1 * | 6/2003 | Weske et al. | 463/47.1 |
| 6,743,151 | B2 | 6/2004 | Riggs | |
| 2005/0177929 | A1 * | 8/2005 | Greenwald et al. | 2/425 |
| 2006/0100022 | A1 * | 5/2006 | Linsay | 463/47.1 |
| 2009/0253526 | A1 * | 10/2009 | Koudele et al. | 473/155 |
| 2011/0283792 | A1 * | 11/2011 | Tung | 73/494 |
| 2013/0098890 | A1 | 4/2013 | Virnich | |
| 2013/0143718 | A1 * | 6/2013 | Pani et al. | 482/8 |

* cited by examiner

*Primary Examiner* — Lawrence Galka

(57) ABSTRACT

A contact sensing device and system includes all the required sensing components, including a capacitive sensor and an elongate portion configured to generate at least one sense signal upon contacting at least one substance. All necessary sensing components are contained in a handheld device and do not require conductive contact surfaces to detect contact with a target area. The sport of fencing benefits in particular from this contact sensing device and system.

22 Claims, 5 Drawing Sheets

CONTACT SENSING DEVICE AND SYSTEM

BACKGROUND AND SUMMARY

The modern sport of fencing is hundreds of years old. Historically, referees and bout directors awarded points (or touches—where one opponent's weapon blade or tip makes contact with the target area of the other opponent) by visually observing two opponents and determining whether a touch occurred and whether the fencer scoring the touch should be awarded a point based on existing rules. The object of saber fencing, based on cavalry fencing on horseback, is to score touches by contacting a blade or tip of a fencer's weapon with an opponent's target area (above that opponent's waist including his arms and head). The object of foil fencing is to score touches by contacting the tip of a fencer's weapon with an opponent's target area (the opponent's torso). The object of epee fencing, based on first-blood duels, is to score touches by contacting the tip of a fencer's weapon with an opponent's target area (any part of the opponent's body). Each form of modern sport of fencing is very rapid. Often actions, contacts, and target areas are difficult to visually see. Modern fencing weapons are so light that skilled fencers can manipulate them with extreme speed in flurries of action. This speed renders it difficult to determine when touches are scored. Even where several officials are employed to judge a match, visual identification of scoring maneuvers is difficult. Disagreement between officials often occurs, due to the inconsistency in the quality of perspective enjoyed by the various officials. Moreover, judgment by visual observation is a subjective criterion, and the acuity of vision may vary among officials, and even in the same official.

Figure 1:
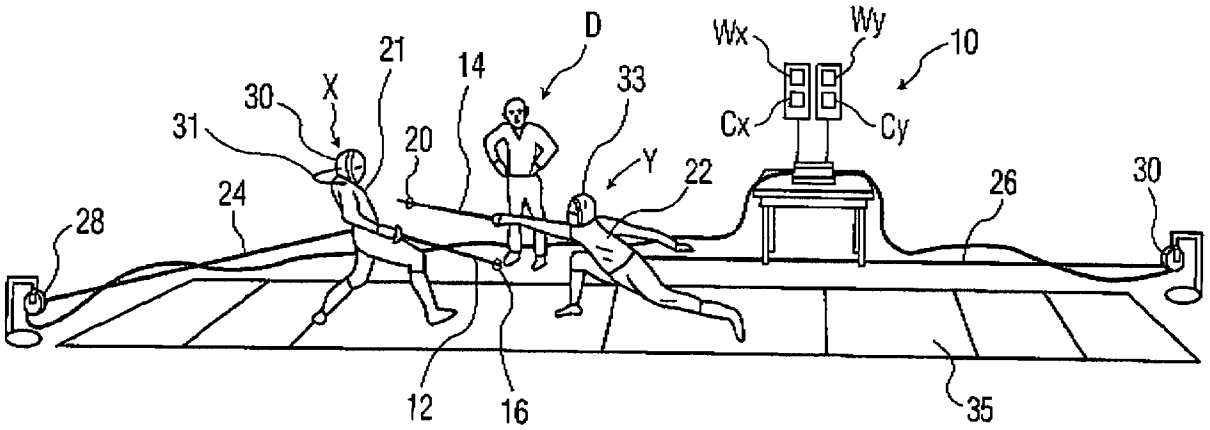
FIG. 1 PRIOR ART

In the 1970s electronic circuits were used to aid in awarding touches. FIG. 1 depicts the current state of the art fencing scoring system. Each fencer X, Y holds a weapon 12, 14 which includes a blade 20 connected to a wire running down each fencer's sleeve (not shown) and connected behind each fencer to a reel wire 24, 26 affixed to a retractable reel 28, 30. Each fencer X, Y wears a jacket 21, 22 which can be made of a conductive material, a mask 30 which can be made of conductive material, and a wire 31 connecting the mask to the jacket 21. The terminal of the reel wire 24, 26 is also connected electrically to the fencer's jacket 21, 22. Each reel 28, 30 is connected to an electrical scoring apparatus 10 that has indicators Wx, Cx, Wy, Cy which alternately illuminate to indicate a touch. If the weapon being fenced is saber, then when fencer Y in FIG. 1 contacts fencer X with any portion of the blade 20 of weapon 14 on a conductive area of either jacket 22 or mask 33, a circuit connects and indicator light Wy indicates fencer A scored a touch. A referee or director D will use this information and his or her visualization of the action to decide whether fender Y's touch should be awarded a point. When fencer X in FIG. 1 contacts fencer Y with the blade 16 of saber 12 on fencer Y's conductive area of either jacket 22 or mask 33, a circuit connects and indicator light Wx illuminates. Often both lights Wy and Wx will illuminate and a director or referee will need to determine to which fencer, if any, a touch should be awarded according to the rules of saber fencing.

Foil fencing includes a similar configuration to the saber configuration of FIG. 1, except each fencer X, Y hold a foil and jackets 21, 22 have a conductive target area comprising the fencer's torso. A valid touch signal in foil includes the breaking of a first circuit and completing a second. A foil has a movable contact on its tip, which is depressed whenever the tip touches an object, breaking the first electrical circuit. Each contestant wears a vest-like garment which covers the valid target portion of his body. The vest has a conductive surface, and is connected in a second circuit between the electrical scoring apparatus 10 and the opponent's foil. The movable contact on each foil is itself conductive. When the movable contact of one fencer's foil touches the opponent's conductive vest, the second electrical circuit is completed, and the first circuit is broken, producing a valid touch signal (thus illuminating respective indicator Wx or Wy). An invalid touch in foil is indicated merely by the breaking of the first circuit (thus illuminating respective indicator Cx, Cy), since in an invalid touch, the foil fails to contact the opponent's vest.

Epee fencing includes a similar configuration to the saber configuration of FIG. 1, except each fencer X, Y hold an epee and wear a jacket 21, 22 that need not include a conductive area. A touch signal in epee constitutes simply the making of one circuit. The movable contact in the epee touch sensor assembly completes the circuit on depression in the course of a touch. Errant touches on the piste 35 or on the opponent's weapon body are not scored. Accordingly, if a fencer's epee tip touches the piste 35, or his opponent's weapon, the electrical scoring apparatus 10 disables the scoring indicators, preventing the registration of a touch in response to such errant touches. The movable contact on the epee tip is conductive as in the case of the foil. It is connected to a portion of the electrical scoring apparatus 10 which, if grounded, prevents actuation of the valid touch indicators. The piste 35 is grounded, as is the body of each weapon 12, 14, so that errant touches on the weapon body or the piste 35 are not counted as scores.

A problem associated with the state of the art fencing system is that it requires jackets, vests and masks made of conductive fabrics and materials which do not wear well with sweat or frequent washing. They are constricting to wear and inhibit a fencer's maneuverability and motion. Often fencers have to wear multiple jackets for safety reasons and the conductive garments are an additional layer which can be uncomfortable and hot for fencers who are exerting themselves. Further, fencers are required to be connected to wires such as the cords in their sleeves, reel wires 24, 26, and mask wire 31 which frequently break and easily become tangled and uncomfortable. Additionally, if the equipment fails to connect a circuit in the proper way due to oxidation of a weapon blade or tip or a conductive garment, target area connectivity dead spots, an overabundance of sweat, a malfunction of wire, or the electrical connection anywhere between electrical scoring apparatus 10 weapon 12, 14 all can affect the outcome of a match and cause for difficulty in scoring a bout. The circuitry used in current state of the art fencing scoring systems is somewhat unreliable and scoring equipment is prone to malfunction, leading to inaccurate scoring results and lengthy downtime while the fencer attempts to "fix" any malfunctioning fencing equipment. Additionally, fencing equipment can be quite costly as simply to engage in electrical scoring a pair of fencers requires electrical scoring apparatus 10, two reels 28, 30, two electrical wires connecting reels 28, 30 to electrical scoring apparatus 10, wires in fencers' sleeves, etc which can cost thousands of dollars.

Contact sensing probes are used in industry to detect capacitance of non-conductive materials such as textiles. Capacitive sensors measure capacitance by contact and non-contact techniques. Non-contact sensors measure disruption in capacitive electron flow. Contact capacitive sensors detect capacitance changes when a lead contacts a surface. Contact capacitive sensors can detect different material properties of the surface they contact. For example, contacting a metal material versus a non-conductive material, or contacting concrete versus plaster. Capacitive sensors can also distinguish between various kinds of textiles based on their relatively unique resistivity.

Capacitance describes how the space between two conductors affects an electric field between them. If two metal plates are placed with a gap between them and a voltage is applied to one of the plates, an electric field will exist between the plates. This electric field is the result of the difference between electric charges that are stored on the surfaces of the plates. Capacitance refers to the "capacity" of the two plates to hold this charge. In single probe sensing, a conductive probe contacts a surface. A sensor measures changes in current across a resistor connected to the probe to determine the dielectric constant of the contacted surface. The sensing surface of the probe is the electrified plate and what you're measuring is the target. Capacitive sensors can be very effective in measuring presence, density, thickness, and location of non-conductors as well. Non-conductive materials like plastic have a different dielectric constant than air. The dielectric constant determines how a non-conductive material affects capacitance between two conductors. When a non-conductor is inserted between the probe and a stationary reference target, such as the human body, the sensing field passes through the material to the grounded target. The presence of the non-conductive material changes the dielectric and therefore changes the capacitance. The capacitance will change in relationship to the thickness and density of the material.

The invention overcomes the problems of the prior art by providing a contact sensing device and system which embodies all the required sensing components in a handheld device and does not require conductive contact surfaces to detect contact with a target area. The invention is also entirely self-contained and requires no additional wiring to be connected outside the personal system. In the fencing system example, this will remarkably increase the system reliability, the fencer's comfort and maneuverability, and reduce the cost and quantify of equipment subject to malfunction and repair needed in the prior art system.

The invention achieves this in a first aspect by a handheld device for sensing contact with a substance which includes a capacitive sensor that includes an elongate portion configured to generate at least one sense signal upon said elongate portion contacting at least one substance; a processor for receiving the sense signal from the capacitive sensor, processing the at least one sense signal to determine a property of the at least one substance, and for generating an indicator signal; and an indicator which receives the indicator signal and indicates if the capacitive sensor contacts the substance.

In one embodiment a portion of the elongate portion of the capacitive sensor includes a contact sensing lead for sensing contact between a lateral side of a portion of the elongate portion and the at least one substance.

In another embodiment, the elongate portion is a blade or tip of a fencing weapon.

In another embodiment the device includes a plurality of indicators and the processor determines which indicator or indicators receives an indicator signal based on the determined property of the at least one substance. The processor can contain logic for determining which of the plurality of indicators receives an indicator signal.

In one embodiment, the property of the at least one substance is a material characteristic. In another embodiment, the property of the at least one substance is conductivity. In another embodiment the property of the at least one substance represents contact on a target area. The processor can also send an indicator signal to one of the plurality of indicators if the capacitive sensor contacts the target area and the processor sends an indicator signal another of the plurality of indicators if the capacitive sensor contacts an area other than the target area.

In another embodiment, the property of the at least one substance is the presence of another device. The processor can be configured to send an indicator signal to one of the plurality of indicators if the capacitive sensor detects the presence of another device.

In another embodiment, the device includes at least one motion sensor for sensing motion of the device. The motion sensor can sense acceleration, speed, and/or direction. The motion sensor can send a motion signal to the processor and the processor processes the motion signal to generate a motion indicator signal.

In one embodiment, the device includes a counter for outputting a count of indicator signals and a memory for storing said count. In still another embodiment, the device includes a display for displaying the count.

In one embodiment, the device includes a power source. In another embodiment the device includes a wireless communication device for transmitting at least one of the indicator signal and the motion indicator signal. The wireless communication device can also receive at least one indicator signal from at least one other device.

In one aspect the invention includes a system for scoring contact between a device and at least one substance including: at least one device for sensing contact with a substance that includes a device for sensing contact with a substance which includes a capacitive sensor that includes an elongate portion configured to generate at least one sense signal upon said elongate portion contacting at least one substance; a processor for receiving the sense signal from the capacitive sensor, processing the at least one sense signal to determine a property of the at least one substance, and for generating an indicator signal; and an indicator which receives the indicator signal and indicates if the capacitive sensor contacts the substance and at least one target comprising at least one substance detectible by the device.

In one embodiment the system includes at least two devices for sensing contact. In another embodiment the two devices communicate wirelessly.

Other aspects and advantages of embodiments of the present invention will become apparent from the following detailed description, taken in conjunction with the accompanying drawings, illustrated by way of example of the principles of the invention.

FIGURES

Figure 2:
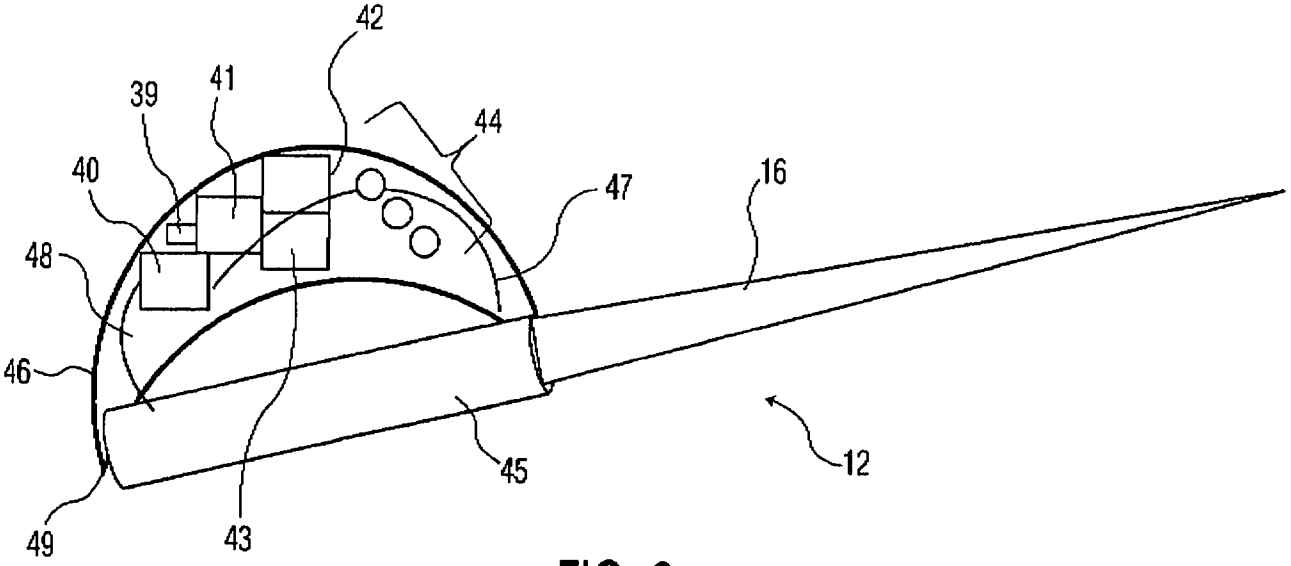
Figure 3:
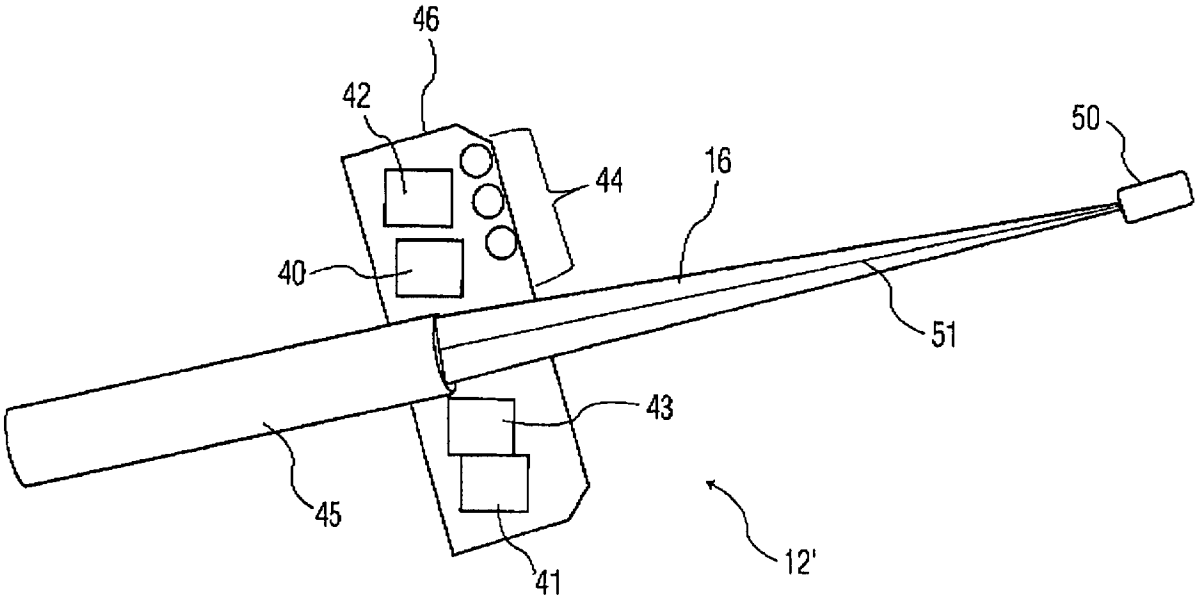
Figure 4:
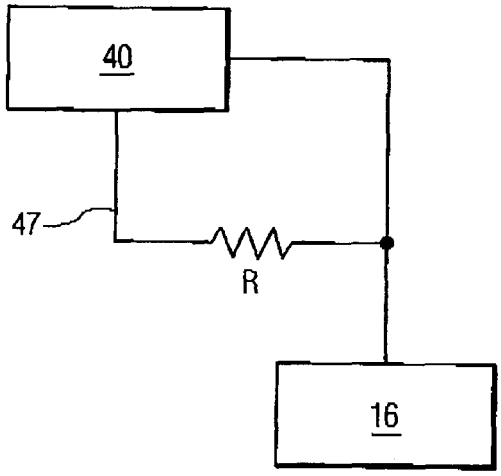
Figure 5:
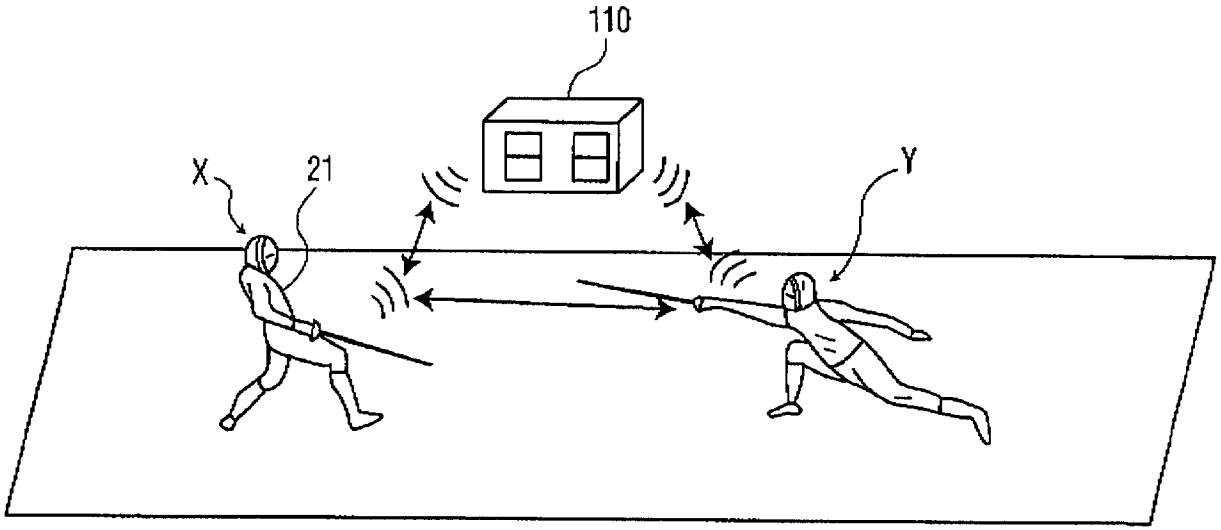

FIG. 1 depicts a prior art fencing system;
FIG. 2 depicts a first device according to the invention;
FIG. 3 depicts a second device according to the invention;
FIG. 4 depicts a circuit diagram according to the invention;
FIG. 5 depicts a fencing system according to the invention.

DETAILED DESCRIPTION

FIG. 2 depicts a handheld device for sensing contact with a substance. In the present example, FIG. 2 depicts a saber 12. Saber 12 includes a blade 16, a handle 45, and a guard 46. Blade 16 extends through a hollow portion of handle 45 where it terminates at a pommel 49. Blade 16 is conductive, frequently made of steel or some other metal alloy. FIG. 2 affords a view of saber 12 where the underside of guard 46 is visible. Processor 40, power supply 41, wireless device 43, and motion sensor 42 are situated on the inside surface of guard 46 facing handle 45. Saber 12 also includes indicators 44 which can be composed of a series of LED lights or some other visible, audible, or tactile indicator know in the indicator art. Blade 16 of saber 12 acts as a sensor. Since touches are scored in saber fencing when any portion of the blade contacts an opponent's target area (i.e., above the opponent's waist, including the arms, weapon hand, and head) the entire length of blade 16 is configured to act as a sensor. In alternative examples only a portion of blade 16 may be used as the sensor. Processor 40 can contain logic which toggles the state of a send lead 47. When the send lead 47 changes voltage state, it will eventually change the voltage state of the blade 16. The delay between the send lead 47 changing and the blade 16 changing is determined by processor 40 measuring an RC time constant, defined by R*C, where R is the value of a resistor (shown in more detail in FIG. 4) and C is the capacitance at blade 16, plus any other capacitance (for example the contact with a human body covered by a fabric with a particular density and dielectric constant) contacting blade 16. Adding a small capacitor in parallel with the body capacitance can stabilize the sensed readings.

A saber 12 as depicted in FIG. 12 allows for the use of non-conductive materials to represent valid target areas for the sport of fencing. Processor 40 can be configured to convert the sensed capacitance of a contacted substance to determine whether blade 16 contacts a valid target area or not. This eliminates the need for conductive fabric jackets and electrical connection between a mask and jacket. Processor 40 can contain logic which upon sensing contact with a valid target area (for example nylon fabric which is often used in protective jackets) causes one indicator LED of indicators 44 to illuminate. Processor 40 can also be programmed to recognize more than one material capable of being sensed by blade 16 as valid target. Thus the surface of a mask need not be identical to the surface material of a jacket and both can still be considered valid target. Jackets can simply be made from different material than pants and processor 40 can be programmed to output an indicator signal when it senses contact with only the materials from which jackets are made. Additionally, processor 40 can be configured to determine when blade 16 senses contact with an opponent's blade or guard and can differentiate between that contact and contact with a target area.

Additionally, processor 40 can signal wireless device 43 to transmit a signal indicating a valid touch to an electrical scoring device which will then cause a respective appropriate indicator light to illuminate. Wireless device 43 can be any wireless device known to one of skill in the art, such as an IEEE 802.11 compliant device, or a Bluetooth device. Further processor 40 can signal wireless device 43 to transmit a signal intended for receipt by an opponent's saber. This information can be used to signal an indicator on the opponent's weapon. It can also be transmitted with the output of a motion sensor 42 and a timing device 39 such that electric scoring equipment and/or an opponent's saber can collect adequate information to determine not only which weapon sensed contact with a target area, but also which fencer should be awarded a touch based on the rules of the sport (i.e., under the current rules of saber fencing, if both fencers initiate an attack and neither fencer's blade contacts the other's blade, if one fencer initiated the action by advancing their saber forward first he or she is awarded a touch. If however both fencers advance their weapons relatively simultaneously, no touch is awarded. Transmitting the information that a touch is scored and information on timing and motion of the saber 12 can be very useful in aiding a director in awarding a touch or to render an automated touch award). Motion sensor 42 can be an accelerometer, a gyroscopic sensor, or any other motion sensor presently known to one of skill in the motion sensing art. Timing device 39 can be any timing device known to one of skill in the art. Using wireless device 43 eliminates the need for any wiring to be connected outside the saber 12 or beyond the fencer's personal system. This remarkably increases reliability by eliminating the need for wires and conductive target areas, the fencer's comfort and maneuverability, and reduce the cost of equipment needed in the prior art system. Further, fencers need not be connected to any electrical scoring equipment but can enjoy the same benefits from their sabers alone.

Power supply 41 supplies power for operation of processor 40, indicators 44, motion sensor 42, timing device 39, sensor blade 16 and wireless device 43. Saber 12 can also include a counter (not depicted) and a memory (not depicted) which can keep track of touches and any other relevant statistical information. The counter can have an automatic reset once it reaches a threshold, or it can resent when instructed from electrical scoring equipment or opponent's weapon. Indicator 44 may also include a display for displaying information from a counter, an electrical scoring system, or an opponent's weapon.

The saber configuration of FIG. 2 can also be used as a handheld sensor for a variety of additional use cases beyond the sport of fencing. Processor 40 can be programmed to sense contact between a sensor (i.e., blade 16) and any detectible material having a dielectric constant and density. Such a hand-held device for sensing contact with a substance has a variety of uses in industry (i.e., field testing, package tracking tools, etc.), academia (i.e., automated test scoring), sports (i.e., terrain sensing shoes), handicap assistance (i.e., a sensing stick for a blind person, touch sensing for burn victims), and many other useful configurations.

FIG. 3 depicts a weapon 12' similar to the saber 12 of FIG. 2. Weapon 12' contains all the components of saber 12 with a difference that tip-portion 50 acts as a sensor as opposed to the entire length of blade 16. Tip-portion 50 can be connected to processor 40 by a wire that runs along blade 16 or is situated with a groove or notch of blade 16. Alternatively blade 16 can be the conductive pathway between tip-portion 50 and processor 40. This configuration is suitable for foil or epee fencing where only contact with the blade tip with an opponent's target area may be scored as a touch. This eliminates the need for conductive fabric jackets to cover fencers' target areas and eliminates the need for relatively complex tips containing springs and movable contacts for completing or breaking electrical circuits. Weapon 12' can be a foil with a relatively small guard 46 depicted in cutaway for FIG. 3 to show Processor 40, power supply 41, wireless device 43, indicators 44, and motion sensor 42. A timing device such as timing device 39 in FIG. 2 may not be necessary for weapon 12' if in an epee configuration where information regarding timing of motion is not required.

FIG. 4 depicts a circuit diagram of the capacitive sensor in FIG. 2. Blade 16 acts as a sensor lead. Processor 40 is electrically connected to a send lead 47 which is electrically connected to a resistor R. Processor 40 toggles the state of send lead 47. When the send lead 47 changes state, it will eventually change the state of the blade 16. The delay between the send lead 47 changing and the blade 16 changing state is determined by processor 40 measuring an RC time constant, defined by R*C, where R is the resistance value of a resistor R and C is the capacitance sensed by blade 16, plus any other capacitance (for example the contact with a human body covered by a fabric with a particular density and dielectric constant) contacting blade 16. Blade 16 can also be embodied as a metallic strip running down a blade of a non-metallic substance, such as suitably flexible plastic or foam.

FIG. 5 depicts a fencing scoring system such that fencers X, Y wireless transmit information from their weapons to electrical scoring apparatus 10 and also to each other's weapons. FIG. 5 clearly shows the freedom of movement enjoyed by fencers using weapons according to the invention as well as the ability to set up a piste in a almost any location without requiring a great deal of wiring and conductive strips to provide grounding. Fencers may use a grounded strip and to be connected via a wire running within or near the fencer's clothing and contacting the piste in order to allow use of lower powered sensors. Using the current invention, conductive pistes can be replaced by non-conductive strips which are lighter and easier to transport and can even be conventional flooring material.

While the invention has been shown and described with reference to certain exemplary embodiments thereof, it will be understood by those skilled in the art that various changes in form and details may be made therein without departing from the spirit and scope of the invention as defined by the appended claims and their equivalents.

What is claimed is:

1. A handheld device for sensing contact with a substance comprising:

a capacitive sensor comprising an elongate portion comprising a blade of a fencing weapon configured to generate at least one sense signal upon said elongate portion contacting at least one substance;

a processor for receiving said at least one sense signal from said capacitive sensor, processing said at least one sense signal to determine a property of the at least one substance, and for generating an indicator signal; and an indicator which receives said indicator signal and indicates if the capacitive sensor contacts the substance;

wherein at least a portion of the elongate portion of said capacitive sensor further comprises a contact sensing lead for sensing contact between a lateral side of said at least a portion of the elongate portion and said at least one substance.

2. The device of claim 1, wherein the device further comprises a plurality of indicators and said processor further determines which of said plurality of indicators receives an indicator signal based on said determined property of the at least one substance.

3. The device of claim 2, wherein the processor contains logic for determining which of said plurality of indicators receives an indicator signal.

4. The device of claim 3, wherein the processor sends an indicator signal to one of the plurality of indicators if the capacitive sensor contacts a target area and the processor sends an indicator signal another of the plurality of indicators if the capacitive sensor contacts an area other than the target area.

5. The device of claim 1, wherein the property of the at least one substance is a material characteristic.

6. The device of claim 1, wherein the property of the at least one substance is conductivity.

7. The device of claim 1, wherein the property of the at least one substance represents contact on a target area.

8. The device of claim 1 wherein the property of the at least one substance comprises presence of another device.

9. The device of claim 8, wherein the processor sends an indicator signal to one of the plurality of indicators if the capacitive sensor contacts another device.

10. The device of claim 1, wherein the device further comprises at least one motion sensor for sensing motion of the device.

11. The device of claim 10, wherein the motion sensor senses at least one of acceleration, speed, and direction.

12. The device of claim 11, wherein the motion sensor sends a motion signal to the processor and the processor processes the motion signal to generate a motion indicator signal.

13. The device of claim 12, further comprising a wireless communication device for transmitting at least one of said indicator signal and said motion indicator signal.

14. The device of claim 13, wherein said wireless communication device further comprises a wireless communication device for receiving at least one indicator signal from at least one other device.

15. The device of claim 1, wherein the device further comprises a counter for outputting a count of indicator signals and a memory for storing said count.

16. The device of claim 15, wherein the device further comprises a display for displaying said count.

17. The device of claim 1, further comprising a power source.

18. A handheld device for sensing contact with a substance comprising:

a capacitive sensor comprising an elongate portion configured to generate at least one sense signal upon said elongate portion contacting at least one substance;

a processor for receiving said at least one sense signal from said capacitive sensor, processing said at least one sense signal to determine a property of the at least one substance, and for generating an indicator signal; and an indicator which receives said indicator signal and indicates if the capacitive sensor contacts the substance; wherein said capacitive sensor further comprises a contact sensor substantially situated at an end-point of said elongate portion for detection of the end-point contacting the at least one substance.

19. The device of claim 18, wherein said elongate portion further comprises a fencing weapon.

20. A system for scoring contact between a device and at least one substance comprising:

at least one device for sensing contact with a substance comprising:

a capacitive sensor configured to generate at least one sense signal upon contacting at least one substance;

a processor for receiving said at least one sense signal from said capacitive sensor, processing said at least one sense signal to determine a property of the at least one substance, and for generating an indicator signal;

an indicator which receives said indicator signal and indicates if the capacitive sensor contacts a specific area; and at least one target comprising at least one substance detectible by said device;

wherein at least a portion of an elongate portion of said capacitive sensor further comprises a contact sensing lead for sensing contact between a lateral side of said at least a portion of the elongate portion and said at least one substance, and wherein the elongate portion further comprises a blade of a fencing weapon.

21. The system of claim 20, wherein the system comprises at least two devices for sensing contact.

22. The system of claim 21, wherein said at least two devices communicate wirelessly.

* * * * *